United States Patent [19]

Jiveman et al.

[11] 4,308,988

[45] Jan. 5, 1982

[54] ENVELOPE

[76] Inventors: Jan Jiveman, 30 Girestavägen, Upplands Väsby, Sweden, S-194 51; Raymond Bengtsson, 33 Östbergshöjden, Älvsjö, Sweden, S-125 37; Rasit Kaya, 38 Kavallerigatan, Upplands Väsby, Sweden, S-194 33; Rune Bengtsson, 54 Stamgatan, Älvsjö, Sweden, S-125 39

[21] Appl. No.: 140,805

[22] Filed: Apr. 16, 1980

[30] Foreign Application Priority Data

Apr. 24, 1979 [SE] Sweden ..... 7903592

[51] Int. Cl.[3] ..... B65D 27/14

[52] U.S. Cl. ..... 229/80

[58] Field of Search ..... 229/68 R, 69, 80; 206/602

[56] References Cited

U.S. PATENT DOCUMENTS

| | | | |
|---|---|---|---|
| 2,374,026 | 4/1945 | McKeen | 229/68 |
| 2,804,395 | 8/1957 | Boyajian | 117/44 |
| 3,263,904 | 8/1966 | Warp | 229/68 R |
| 3,265,289 | 8/1966 | Hiersteiner | 229/80 |
| 3,446,421 | 5/1969 | Carrigan et al. | 229/70 |

FOREIGN PATENT DOCUMENTS

| | | |
|---|---|---|
| 1486328 | of 0000 | United Kingdom . |
| 1509325 | of 0000 | United Kingdom . |

*Primary Examiner*—George T. Hall

*Attorney, Agent, or Firm*—Burns, Doane, Swecker & Mathis

[57] ABSTRACT

The invention relates to an envelope of plastic sheet material consisting of a thermoplastic sheet, which is laminated to a sheet of hydrophilic material at least on the side forming the outside of the envelope. The flap belonging to the envelope is laminated to a paper layer at least on its inside, said layer supporting a gumming. The invention also relates to a method for continuously making such envelopes, a web of a plastic sheet laminated according to the above being folded with its edge portions towards a central area, which is left free. One or more paper webs are laminated to this central area and punched-out areas are made in the central area to a desired shape of the flaps of the envelopes. The envelopes are thereafter sealed along their sides by means of transversal welding seams and separated from each other.

8 Claims, 2 Drawing Figures

ENVELOPE

This invention refers to envelopes, especially of plastic sheet material. The invention also concerns a method for the manufacture of such envelopes.

It has been desired for a long time to make envelopes of plastic sheet materials. Such envelopes would have a number of advantages in comparison with conventional paper envelopes. Thus, in rapid manufacture in automatically operating machines they can be cheaper than paper envelopes and moreover, such envelopes will better resist water and soiling. As the plastic sheet can also be made transparent, interesting application fields may also arise in commercial advertising and the like.

However, envelopes of plastic sheeting have so far not been used to any large extent, and the reason is mainly two considerable shortcomings. As plastic sheeting is relatively soft, it has not been possible to handle envelopes of such a sheet in stuffing machinery of known types, where a certain stiffness of the envelope material is required for mechanical opening, stuffing and sealing of the envelopes. Moreover, it has not been possible to seal envelopes of plastic sheet in conventional manner by means of a gummed flap, as the gumming does not adhere to the surface of the plastic sheet, which is usually strongly hydrophobic.

These disadvantages are eliminated by the present invention and an envelope is provided which can be used in mechanical stuffing and can be sealed by means of a gummed flap of a conventional type. According to the invention, the present envelope is characterized in that it is made from a thermoplastic sheet, which is laminated on the side forming the outside of the envelope with a sheet of hydrophilic material, and that the flap of the envelope is laminated to a paper layer at least on its inside, said layer supporting a gumming. The thermoplastic sheet is preferably calendered but can also be blown or prepared in some other way.

DETAILED DESCRIPTION OF THE PREFERRED EMBODIMENTS

Figure 1:
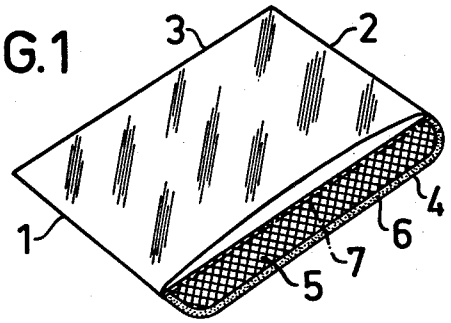
FIG. 1 schematically shows an envelope according to the invention.

FIG. 1 is a schematical perspective view of an envelope according to the present invention. The envelope is made of a plastic sheet folded around the bottom fold 3 and sealed in the sides by the welding seams 1 and 2. The envelope also has a flap 4, laminated to a paper layer 5 and supporting a gumming, which is indicated at 6. For the sake of clearness, the laminated paper is shown by cross-hatching. Usually the flap is gummed across the whole of its surface, as this is easiest to manufacture, but a gumming along the edge of the flap only is also possible. At the transition from the flap to the envelope itself there is arranged a longitudinal scoring line 7. The folding of the flap over the envelope at its sealing is made easier by this scoring line.

In the drawing, the envelope is shown with a paper layer laminated to the inside of the flap only. However, it can often also be suitable to laminate paper layers to both sides of the flap. In this way the risk is avoided that the flap bends due to the different behavior of the plastic sheet and the paper when influenced by moisture, heat and other factors.

By the lamination and the possible calendering, the plastic sheet material obtains a stiffness sufficient for an envelope manufactured therefrom to be treated in a conventional stuffing apparatus. As plastic material in the sheet, a calendered thermoplastic resin, such as polypropylene, HD-polyethylene (high density polyethylene), co-extruded HD and LD polyetylene, polyvinyl chloride, polyester or polyamide are preferably used. For economical reasons the three first-mentioned polyolefin materials are preferred. The other materials are more expensive, and polyvinyl chloride is not unobjectionable for environmental reasons, as noxious gases are formed at its combustion.

As the thermoplastic sheet in the envelope is laminated to a sheet of hydrophilic material on the side forming the outside of the envelope, a water-moistened gumming of a conventional type will adhere to the hydrophilic surface. Also when using self-adhering gumming of known types, a better adhesion will be obtained to the hydrophilic surface. Examples of suitable hydrophilic sheet materials are regenerated viscose (cellophane), cellulose acetate, polyvinyl alcohol and polyvinyl acetate, and also paper. The cellulose acetate and the polyvinyl acetate can be hydrolyzed to a suitable degree to obtain hydrophilic properties.

The composite plastic sheet of the envelope has conveniently a total thickness of 10–50 $\mu$m and preferably 25–30 $\mu$m. About 35 $\mu$m has been found to be suitable within this range. It is evident that the required thickness is largely decided by the resistance and stiffness properties of the sheet material used, so that a more resistant and stiffer sheet can be used thinner. A suitable thickness within the ranges indicated can be established on the basis of practical tests by one skilled in the art.

In the laminated sheet, the calendered thermoplastic sheet has the greatest thickness since the thermoplastic sheet determines the strength and stiffness of the envelope. The hydrophilic sheet can be made very thin as its only object is to give the surface hydrophilic porperties. Thus, its thickness need not be greater than what is necessary to give the surface the desired hydrophilic properties.

The thickness of the paper being laminated to the flap is not especially critical, but should only be sufficient to give the flap the required strength for mechanical handling.

At the transition from the flap of the envelope to the envelope itself, a longitudinal scoring line 7 should preferably be arranged. A folding guide is obtained by this scoring line so that the flap of the envelope can be easily folded over the envelope for sealing. Especially in mechanical stuffing, such a folding guide is of importance.

According to a suitable embodiment of the invention, the plastic sheet material used for the envelope is transparent so that the contents thus are visible through the envelope. In many cases this can be desirable, e.g. in advertising and the like. Of course, the plastic sheet material can also be coloured transparent or opaque over the whole or part of the surface of the envelope. This can be achieved by a suitable printing or colouring of the plastic sheet material used as starting material. It is then also an advantage that the printing adheres easily to the hydrophilic outside of the envelope, and no pretreatment of the sheet is required.

The invention also includes a method of producing the present envelope. The various steps included in the method are shown schematically in FIG. 2 of the drawing.

Figure 2:
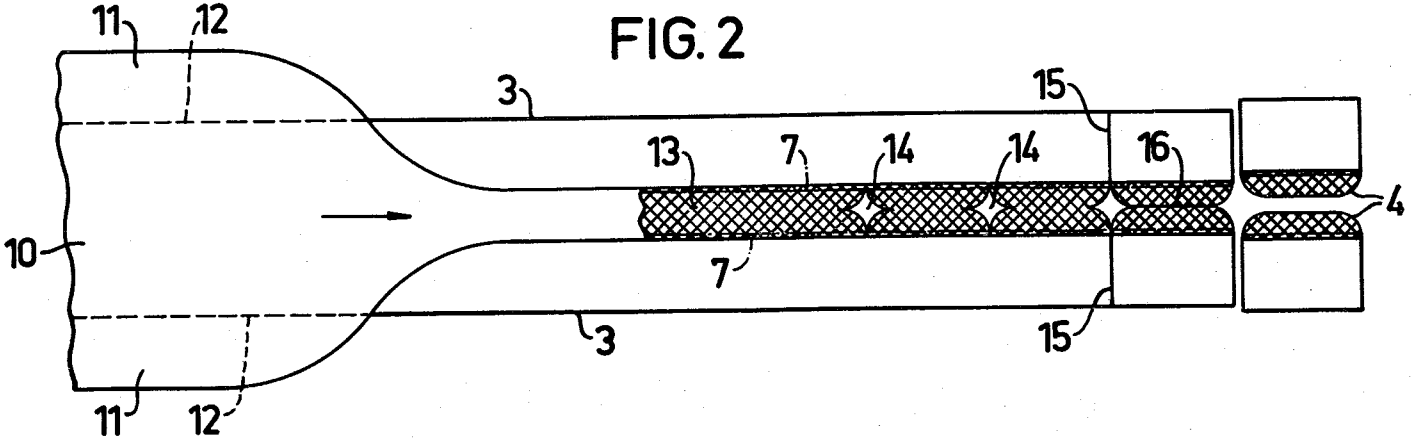
FIG. 2 schematically shows the various steps in continuous manufacture of envelopes according to the invention.

In FIG. 2 is shown from above a web 10 of a plastic sheet intended as a starting material, which consists of a laminate of a preferably calendered thermoplastic sheet and a hydrophilic sheet, the hydrophilic layer according to the drawing being located on the underside of the web. The web is fed at a suitable rate in the direction of the arrow shown and its outer edge portions 11 are folded upwards and inwards towards the centre of the web along the folding lines indicated by the dashed lines 12, which after the folding form the bottom folds 3 in the finished envelopes. The widths of the web 10 and of the folded parts 11 are adapted in such a way that the width of the folded parts on each side corresponds to the height of a finished envelope and at the centre of the web a free area is obtained, the width of which corresponds to twice the height of the flap of the finished envelope.

After the folding, at least one web 13 of paper (shown cross-hatched in the figure) of the same width as the free control area or of a slightly smaller width than this is laminated to the free central area. This paper web can be provided in advance with a gumming on its upper side and a laminated thermoplastic layer on the underside so that it can be laminated to the central portion by heating. This is a preferred embodiment, but the lamination can also be carried out by an added adhesive and the gumming can be applied in a separate subsequent step, which is not shown in the drawing.

If paper webs are to be laminated to both sides of the envelope flaps, an additional paper web can be supplied from below and be laminated to the free central area in the same way and preferably at the same time as the paper web 13. In each case both paper webs should be laminated to the flaps before the following process steps are carried out.

After applying the paper web or webs, the central area is provided with longitudinal scoring lines, which are indicated by the dashed and dotted lines 7. The scoring lines are applied in the central area exactly where this area meets the folded edge areas 11, and scoring wheels of a conventional construction are used for the scoring.

After the scoring lines 7 have been applied, the central area and the laminated paper web or webs 13 are provided with punched-out areas 14, which are formed along the edges of the final envelope flap. It is preferred that the envelope flaps are made with relatively rounded edges and not with pointed ones.

Finally the sides of the envelope are welded shut by means of transversal welding seams 15 and the finished envelopes are separated by cutting along the welding seams and along a section line 16 of the central portion with the flaps. The welding of the sides of the envelope and cutting along the welding seams can take place simultaneously in a conventional manner. The longitudinal secton line 16 can be obtained by a cutting wheel of a conventional type. Depending on the design of the apparatus the envelopes can be separated along the lateral seams and along the flaps simultaneously or in an arbitrary order.

The separated envelopes can then be led to bundling and packing, which is not shown in the drawing.

In another embodiment of the manufacturing process, only one of the edges of the plastic sheet can be folded towards the other one, leaving a narrower edge portion at the other edge of the web, where the flap is to be formed. One or more narrower paper webs can then be laminated to this free edge portion and the flaps be punched out, after which the envelopes are welded shut at their sides and separated. Thus, only one single row of envelopes instead of a double one is obtained. For example, this can be suitable if it is intended to make such big envelopes that the width of the web is not sufficient for a double row. However, the principle for carrying out the invention remains unchanged.

It is apparent that the above manufacturing process according to the invention can be carried out rapidly and automatically, starting from webs of plastic sheeting and paper. In this way the manufacture will be simple and cheap. The construction of the apparatus for the various steps of the manufacturing process can easily be established by one skilled in the art starting from previously known equipment for treatment of webs of materials.

If the finished envelopes are to be provided with printing, it is suitable to apply this to the web 10 of plastic sheet in advance. By a device with optical scanning and photo cell, the feeding of the sheet can then be controlled in such a way that a correct printing is obtained on the individual envelopes. Such controlling apparatus is previously known to those skilled in the art.

By the present invention envelopes of plastic sheet material with a number of advantageous properties are obtained, which can be manufactured rapidly, simply and at a low cost.

We claim:

1. An envelope of plastic sheet material provided with a flap, the plastic sheet material being a thermoplastic sheet, which is laminated to a sheet of a hydrophilic material at least on a side forming an outside of the envelope, and the flap of the envelope being laminated to a paper layer at least on an inside of the flap, said layer supporting a gumming.

2. The envelope of claim 1, characterized in that the plastic sheet material is calendered.

3. The envelope of claim 1 or 2, characterized in that the thermoplastic sheet consists of calendered polypropylene, HD-polyethylene, coextruded HD- and LD-polyetylene, polyvinyl chloride, polyester or polyamide.

4. The envelope of claim 1, characterized in that the hydrophilic material consists of regenerated viscose (cellophane), cellulose acetate, polyvinyl alcohol, polyvinyl acetate or paper.

5. The envelope of claim 1, characterized in that the envelope is provided with a longitudinal scoring line at the transition of the flap to the envelope itself.

6. The envelope of claim 1, characterized in that the plastic sheet material is transparent.

7. The envelope of claim 1, characterized in that the plastic sheet material has a total thickness of 10–50 μm, preferably 25–50 μm.

8. The envelope of claim 1, characterized in that the flap of the envelope is laminated to a paper layer on both its sides.

* * * * *